US006425463B1

(12) United States Patent
Broyan

(10) Patent No.: US 6,425,463 B1
(45) Date of Patent: Jul. 30, 2002

(54) NON-PERSONNEL LIFTING DEVICE

(76) Inventor: Frederick Kenneth Broyan, 423 E. Tenth St., Berwick, PA (US) 18603

( * ) Notice: Subject to any disclaimer, the term of this patent is extended or adjusted under 35 U.S.C. 154(b) by 0 days.

(21) Appl. No.: 09/525,415

(22) Filed: Mar. 15, 2000

(51) Int. Cl.[7] ..... B66B 7/00; B66B 9/00

(52) U.S. Cl. ..... 187/411; 187/414; 187/254; 187/266; 187/325; 187/408; 187/406; 52/30

(58) Field of Search ..... 187/254, 255, 187/266, 262, 313, 325, 401, 406, 407, 408, 411, 414, 900; 52/30, 79.1, 79.2, 79.12, 731.1, 731.2, 731.5

(56) References Cited

U.S. PATENT DOCUMENTS

| | | | | | |
|---|---|---|---|---|---|
| 837,826 | A | * | 12/1906 | Handlan, Jr. | 187/414 X |
| 966,769 | A | * | 8/1910 | Rintenhouse | 187/411 X |
| 1,658,042 | A | * | 2/1928 | Druschel | 187/900 |
| 1,676,161 | A | * | 7/1928 | Schiller et al. | 187/408 X |
| 2,086,002 | A | * | 7/1937 | Shepard | 187/266 X |
| 2,537,075 | A | * | 1/1951 | Margles | 187/266 X |
| 3,845,842 | A | * | 11/1974 | Johnson | 187/266 |
| 4,231,148 | A | * | 11/1980 | Harding | 52/30 X |
| 4,986,041 | A | * | 1/1991 | Prewer et al. | 187/414 X |
| 5,012,621 | A | * | 5/1991 | Power et al. | 52/30 |
| 5,788,018 | A | * | 8/1998 | Mendelsohn et al. | 187/266 X |
| 6,167,670 | B1 | * | 1/2001 | Reite et al. | 187/414 X |
| 6,193,018 | B1 | * | 2/2001 | Schroder-Brumloop et al. | 187/266 |

FOREIGN PATENT DOCUMENTS

| | | | | |
|---|---|---|---|---|
| JP | 3-243586 | A | * 10/1991 | 187/411 |
| JP | 5-39655 | A | * 6/1993 | 187/414 |
| JP | 5-319728 | A | * 12/1993 | 187/414 |
| JP | 10-87215 | A | * 4/1998 | |
| JP | 10-157945 | A | * 6/1998 | |

* cited by examiner

*Primary Examiner*—Eileen D. Lillis
*Assistant Examiner*—Thuy V. Tran
(74) *Attorney, Agent, or Firm*—Thomas R. Shaffer, Esq.

(57) ABSTRACT

A lifting device for transporting items of personal property between floors of a building is provided which includes an a vertically adjustable outer frame, a pair of vertically adjustable spaced apart guide rails attached to the outer frame, a lift container having guide members positioned thereon to guide the lift container along said guide rails and to allow the lift container to move vertically along said guide rails, and a drive mechanism including a motorized drive pulley, a plurality of idler pulleys and drive belt. The drive belt is connected at one end to a top wall of said lifting container and is connected at an opposite end to the bottom wall of said lifting container. The drive belt is in contact with and powered by the drive pulley such that operating the drive pulley in a first direction causes the lift container to move vertically upward and operating said drive pulley in a second direction causes the lift container to move vertically downward to desired locations on different floors of a building.

16 Claims, 3 Drawing Sheets

NON-PERSONNEL LIFTING DEVICE

BACKGROUND OF THE INVENTION

1. Field of the Invention.

A non-personnel lifting device is disclosed for transporting property between one floor and another floor in a building having at least two floors.

2. Description of the Prior Art.

Various type of elevators and lifting devices have been proposed in the past.

Schreiber et al., U.S. Pat. No. 3,951,236 discloses a mountable hoist used as a non-personnel lifting device. The invention allows articles to be lifted by the hoist to any desired height including a height above the top of the hoist principal channel member. The patent teaches that a mountable hoist 9 includes a principal channel 10 and a secondary channel 12 movably mounted therein. Principal channel 10 is preferably a segmented channel member which can be increased in height to correspond to the level of the scaffold associated therewith. (Col. 2,.Lines 59–64). This arrangement is best shown in FIG. 2 where secondary channel 12 is shown to telescope within the primary channel 10.

Seitz, U.S. Pat. No. 1,596,462 also discloses a hoist and corresponding hoist frame. The patent teaches that one of the objects of the invention is the provision of a hoist frame in the form of a tower made up of a plurality of sections, thereby permitting the height thereof to be varied according to the requirements. The patent specifically teaches that each of the standards 14 and 17 is provided at its lower end with a sleeve like extension 18, attached in any suitable manner thereto, the outer diameter of the said extension fitting closely into the respective standard to which it is attached, and also into the standard below the same. In order to hold the tower sections in proper positions, the top tower 16 is provided with a plurality of hooks 19' to which are fastened the ends of cables 19' the lower ends of the ladder being wound upon drums 20. (Page 1, lines 62–73). Thus, Seitz discloses one form of a telescopic frame as clearly shown in FIG. 5. This patent also teaches the provisions of platforms 52 which may be placed upon the sectional tower.

Druschel, U.S. Pat. No. 1,658,042 discloses a portable elevator. The frame includes splice plates 26, having a series of holes 27, rigidly secured to the flanges at the bottom end of the upper and intermediate runway channels and splice angles 28, having a series of holes 29, which are rigidly secured to the outside of the webs at the upper ends of the lower and intermediate runway channels, as plainly shown in FIGS. 3 and 4. When the upper and lower channels are aligned with their ends abutting, holes 27 will align with holes 29, and bolts may be passed through these holes to hold the runway sections in proper alignment as shown in FIG. 5. Looking at FIGS. 3 and 4, it appears that some height adjustment could be made by selecting which holes 27 align with which holes 29.

Esenmann, U.S. Pat. No. 5,131,505; Rivera, U.S. Pat. No. 5,690,190; and Olsen et al., U.S. Pat. No. 5,020,641 each teach the provision of elevator guide rails which are formed with segments which are abutted end to end.

Finally, Olsen, U.S. Pat. No. 4,664,230; and Fitzgibbon, U.S. Pat. No. 3,693,761 each disclose elevator systems which employ a top mounted motor with an associated sprocket gear and chain mechanism to provide the lifting force.

There remains a need for a lifting device which is adjustable and flexible and which can be easily installed between floor joists and ceiling joists of existing buildings.

There further remains a need for a lifting device that utilizes inner "C" shaped track as a part of the guide rails and wall frame members.

There further remains a need for a lifting device which utilizes base and ceiling frames attached to an-existing structure to which all the framing hardware is attached.

SUMMARY OF THE INVENTION

A lifting device is disclosed for transporting items of personal property between one floor and another floor in a building having at least two floors, said building also having a lowermost floor of said building being served by said lifting device and an uppermost floor of said building being served by said lifting device. In its simplest form the device comprises:

a. an outer frame having a floor frame portion and a ceiling frame portion provided on each of said at least two floors including the lowermost floor and the uppermost floor of said building, said floor frame portion and said-ceiling frame portion on each floor being interconnected a plurality of wall frame members, said wall frame members being adjustable in height to facilitate installation of the lifting device in said building;

b. a pair of spaced apart guide rails attached to said outer frame and extending between the floor of the lowermost floor and the ceiling of the uppermost floor, said guide rails being vertically positioned [and adjustable in height to facilitate installation of the lifting device in said building];

c. a lift container having a top wall, a bottom wall and at least one side wall (preferably a pair of side walls), each of said side walls having guide members positioned thereon to guide the lift container along said guide rails and to allow the lift container to move vertically along said guide rails; and d. drive means comprising a motorized drive pulley, a plurality of idler pulleys and drive belt means, said drive belt means connected by a first connection means at one end to said top wall of said lifting container and connected by a second connection means at an opposite end to the bottom wall of said lifting container, said drive belt means in contact with said drive pulley and said idler pulleys and being powered by said drive pulley whereby operating the drive pulley in a first direction causes the lift container to move vertically upward and operating said drive pulley in a second direction causes the lift container to move vertically downward to desired locations between the lowermost floor and the uppermost floor.

Various preferred embodiments of the invention will now be described. Preferably, said floor frame portion is positioned over two adjacent spaced-apart floor joists whereby said floor joists support opposite sides of said floor frame portion and wherein the floor frame portion leaves the entire space between the floor joists open and unobstructed. Similarly, said ceiling frame portion is positioned under two adjacent spaced-apart ceiling joists whereby said ceiling joists secure opposite sides of said ceiling frame portion and wherein the ceiling frame portion leaves the entire space between the ceiling joists open and unobstructed.

Preferably, said adjustable side rails and said wall frame members each consist of a "C" shaped inner track piece of which telescopically slides into an outer rail member. Further, said outer rail and inner track member preferably has a generally C-shaped cross-sectional configuration.

The lift container guide members are preferably formed of a non-metallic material such as plastic.

The drive belt means preferably further comprises a toothed belt attached at one end to the top wall of said lifting container, said toothed belt in contact with-said motorized drive pulley and attached at the other end to a wire rope, said wire rope connected to the, bottom wall of said container. An optional counter weight may be provided at the connection point between said toothed belt and said wire rope.

The said second connection means preferably includes a hook on the bottom of said lift container to facilitate attachment of said drive belt means. Said second connection means also preferably includes a tensioning safety spring means. Still further, said second connection means includes a tightening turnbuckle to tighten and maintain a proper tension on said drive belt means. Finally, said second connection means includes a one way self lock device to facilitate attachment of said drive belt means.

DETAILED DESCRIPTION OF THE PREFERRED EMBODIMENTS

Figure 1:
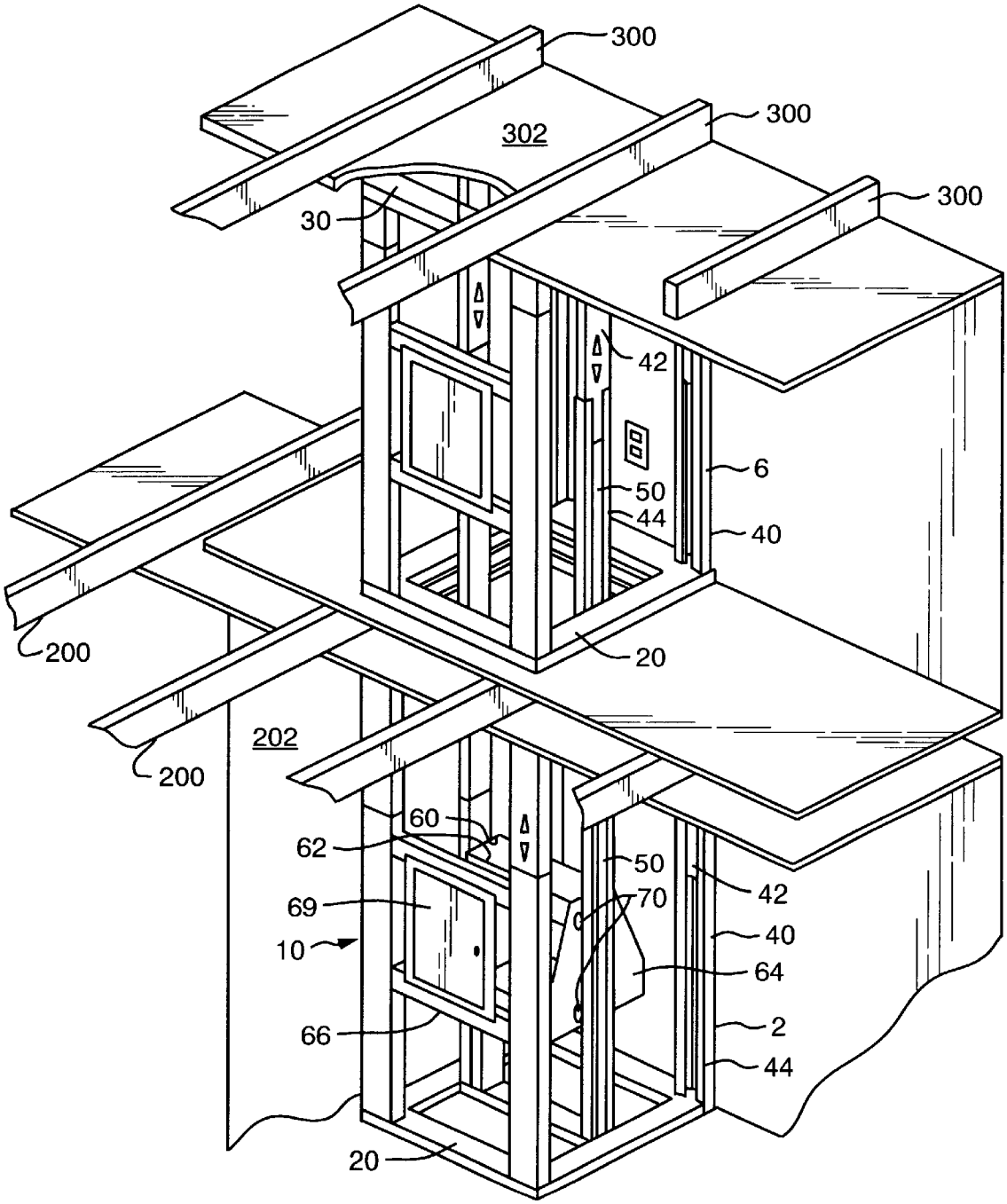
FIG. 1 is an isometric view the lifting device of the present invention.

Referring to the figures, the present invention includes an outer frame 10 which has a floor frame portion 20 and a ceiling frame portion 30 provided on each of said at least two floors including a lower most floor 2 and an upper most floor 6 of a building. The floor frame portion 20 and the ceiling frame portion 30 on each floor are interconnected by a plurality of wall frame members 40. Each of the wall frame members 40 are adjustable in height. This is accomplished by utilizing a piece of "C" shaped inner track 42 which telescopically slides into an outer rail member 44. As will be seen below, an identical arrangement is utilized for guide rails 50.

A pair of spaced apart guide rails 50 are attached to the outer frame 10 and extend between the floor 20 of the lower most floor 2 and the ceiling 30 of the upper most floor 6. The guide rails are vertically positioned and are adjustable in height to facilitate installation of the lifting device in the building. In actuality, the structure of the guide rails is essentially identical to that of the wall frame members. The guide rails 50 likewise include a piece of "C" shaped inner track 42 which telescopically slides into an-outer rail member 44.

An assembleable lift container 60 is provided which has a top wall 62, a bottom wall 64 and a pair of side walls 66. Front and back portions are open as is shown at 68. In order to gain access to the open portion of the lift container 60, an access door 69 is provided at each floor. Upon opening the door 69, access to the interior of the lift container 60 is achieved. Access to the lift container may provided from both the front and from a side.

Each of the side walls 66 of the lift container are provided with guide members 70 which are positioned thereon to guide the lift container 60 along said guide rails 50 and to allow the lift container 60 to move vertically along said guide rails 50.

Figure 2:
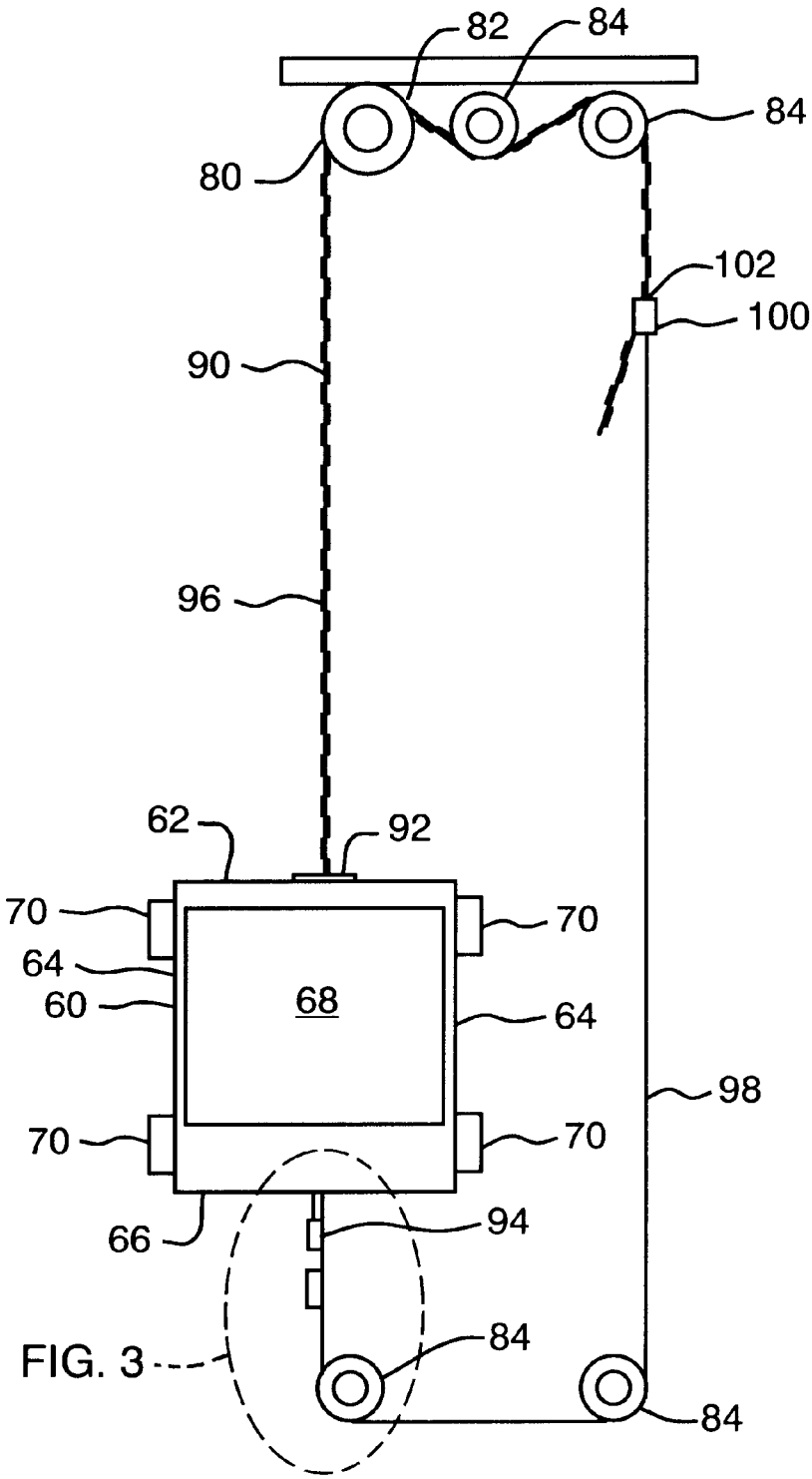
FIG. 2 is a cross-sectional view showing the details of the drive means of the present invention.
Figure 3:
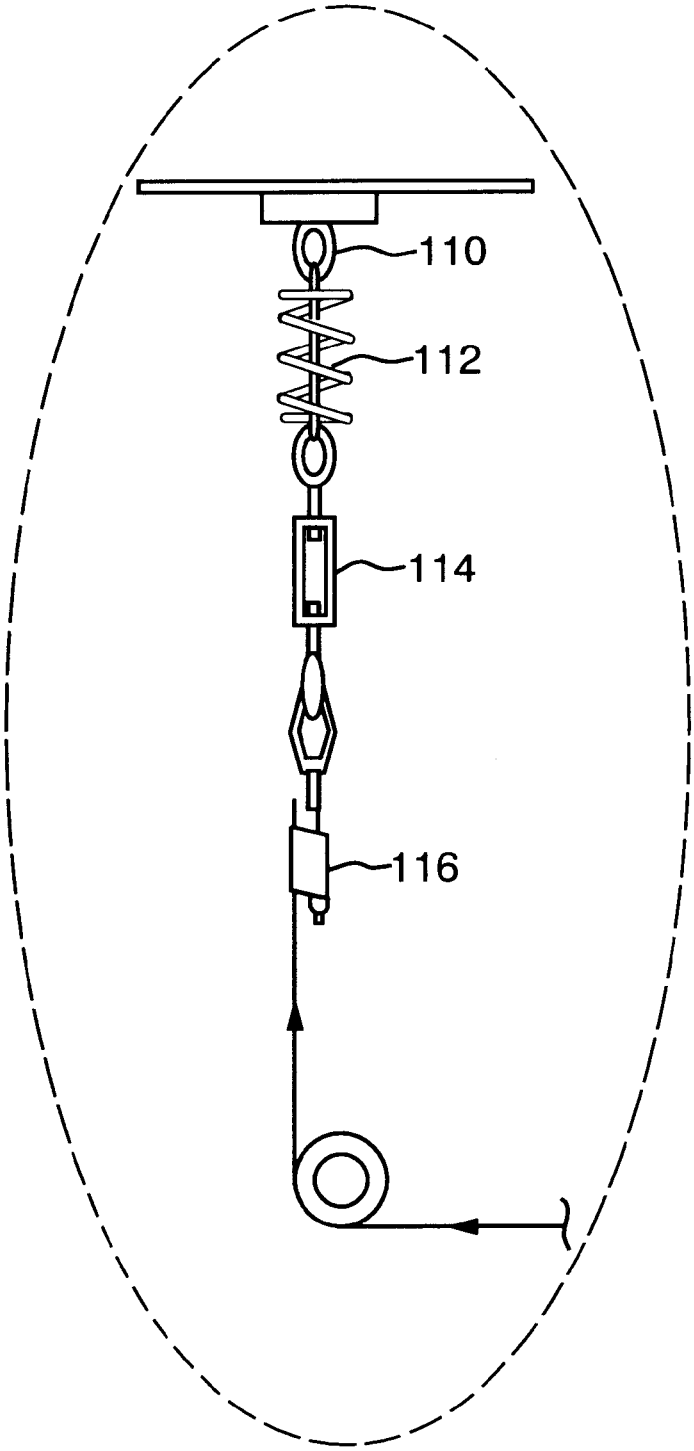
FIG. 3 is an enlarged view of the second connection means of the present invention.

Referring specifically to FIG. 2, drive means 80 comprises a motorized drive pulley 82, a plurality of idler pulleys 84 (two upper idler pulleys and two lower idler pulleys) and a drive belt means 90. The drive belt means 90 is connected at one end by a first connection means 92. The opposite end of the drive belt means 90 is connected by a second connection means 94.

In operation, when the drive pulley operates in a first direction, the lift container is caused to move vertically upward and operating the drive pulley in a second direction causes the lift container to move vertically downward to desired locations between the lower most floor and the upper most floor of the building.

Preferably, the lower frame portion 20 and ceiling frame portion 30 of the outer frame 10 are provided respectively over floor joice 200 such that the entire space between the floor joice 202 remains open and unobstructed. Similarly, the ceiling frame portion 30 is provided below two adjacent spaced apart ceiling joice 300 such that the space between the ceiling joice 302 remains open and unobstructed. Preferably, the outer rail. member 44 described above has a general c-shaped cross sectional configuration. Further, the lift container guide members 70 are preferably formed of a non-metallic material such as plastic.

In the preferred embodiment of the present invention, the drive belt means further comprises a tooth belt 96 attached at one end to the top wall 62 of the lift container 60, said tooth belt in contact with said motorized drive pulley 82 and attached at the other end by means of a connector 100 to a wire rope 98. The wire rope 98 is in turn connected to the bottom-wall 66 of the container 60 by the second connection means 94.

If desired, the lifting device may be provided with an optional counter weight 102 at the location of the connection point between the tooth belt and the tooth belt 96 and the wire rope 98.

The second connection means preferably includes a hook 110 on the bottom of the lift container 60 to facilitate attachment of the drive belt means. Further, a tensioning safety spring means 112 is preferably provided. Also preferably provided is a tightening turn buckle 112 to tighten and maintain proper tension of the drive belt. Finally, a 1-way self lock device 116 is preferably provided as part of the second connection means to facilitate attachment of the wire rope 98.

While, I have shown and described the presently preferred embodiment of my invention, the invention is not limited thereto and may be otherwise variously practiced within the scope of the following claims:

1. A lifting device for transporting items of personal property between one floor and another floor in a building having at least two floors, said building also having a lowermost floor of said building being served by said lifting device and an uppermost floor of said building being served by said lifting device, comprising:

a. an outer frame having a floor frame portion and a ceiling frame portion provided on each of said at least two floors including the lowermost floor and the uppermost floor of said building, said floor frame portion and said ceiling frame portion on each floor being interconnected a plurality of wall frame members, said wall frame members being adjustable in height to facilitate installation of the lifting device in said building;

b. a pair of spaced apart guide rails attached to said outer frame and extending between the floor of the lowermost floor and the ceiling of the uppermost floor, said guide rails being vertically positioned and adjustable in height to facilitate installation of the lifting device in said building;

c. a lift container having a top wall, a bottom wall and at least one side wall, each of said at least one side walls having guide members positioned thereon to guide the lift container along said guide rails and to allow the lift container to move vertically along said guide rails; and d. drive means comprising a motorized drive pulley, a plurality of idler pulleys and drive belt means, said drive belt means connected by a first connection means at one end to said top wall of said lifting container and connected by a second connection means at an opposite end to the bottom wall of said lifting container, said drive belt means in contact with said drive pulley and said idler pulleys and being powered by said drive pulley whereby operating the drive pulley in a first direction causes the lift container to move vertically upward and operating said drive pulley in a second direction causes the lift container to move vertically downward to desired locations between the lowermost floor and the uppermost floor.

2. A lifting device according to claim 1 wherein said floor frame portion is positioned over two adjacent spaced-apart floor joists whereby said floor joists support opposite sides of said floor frame portion and wherein the floor frame portion leaves the entire space between the floor joists open and unobstructed.

3. A lifting device according to claim 1 wherein said ceiling frame portion is positioned under two adjacent spaced-apart ceiling joists whereby said ceiling joists secure opposite sides of said ceiling frame portion and wherein the ceiling frame portion leaves the entire space between the ceiling joists open and unobstructed.

4. A lifting device according to claim 1 wherein said adjustable guide rails and said wall frame members each consist of a piece of "C" shaped inner track which telescopically slides into an outer rail member.

5. A lifting device according to claim 4 wherein said outer rail member has a generally C-shaped cross-sectional configuration.

6. A lifting device according to claim 1 wherein said lift container guide members are formed of a non-metallic material.

7. A lifting device according to claim 1 wherein said drive belt means further comprises a toothed belt attached at one end to the top wall of said lifting container, said toothed belt in contact with said motorized drive pulley and attached at the other end to a wire rope, said wire rope connected to the bottom wall of said container.

8. A lifting device according to claim 7 further comprising a counter weight provided at the connection point between said toothed belt and said wire rope.

9. A lifting device according to claim 1 wherein said second connection means includes a hook on the bottom of said lift container to facilitate attachment of said drive belt means.

10. A lifting device according to claim 1 wherein said second connection means includes a tensioning safety spring means.

11. A lifting device according to claim 1 wherein said second connection means includes a tightening turnbuckle to tighten and maintain a constant proper tension on said drive belt means.

12. A lifting device according to claim 1 wherein said second connection means includes a one way self lock device to facilitate attachment of said drive belt means.

13. A lifting device according to claim 1 wherein said floor frame portion and said ceiling frame portion each have pockets therein to facilitate insertion of the wall frame members and said guide rails.

14. A lifting device according to claim 1 wherein said lift container is formed from two or more component parts which may be easily assembled at a job site.

15. A lifting device according to claim 1 wherein said lift container can be accessed from the front of the lift container.

16. A lifting device according to claim 1 wherein said lift container can be accessed from a side of the lift container.

* * * * *

UNITED STATES PATENT AND TRADEMARK OFFICE

CERTIFICATE OF CORRECTION

PATENT NO. : 6,425,463 B1
DATED : July 30, 2002
INVENTOR(S) : Frederick Kenneth Broyan It is certified that error appears in the above-identified patent and that said Letters Patent is hereby corrected as shown below:

Column 2,
Line 20, delete "-" between "said" and "ceiling"
Line 21, insert -- by -- after "connected"
Line 27, delete "[" after "positioned"
Line 29, delete "]" after "building"

Column 3,
Line 3, delete "-" between "with" and "said"
Line 5, delete "," after "the"
Line 23, ":" after "invention" should read -- . -- after "invention"
Line 50, delete "-" between "an" and "outer"
Line 58, insert -- by -- after "may"

Column 4,
Lines 13, 14, 16 and 17, "joice" should read -- joist --
Line 18, delete "." after "rail"
Line 28, delete "-" between "bottom" and "wall"
Line 32, delete "the tooth belt and"
Line 43, delete "," after "While"
Line 58, insert -- by -- after "connected"

Signed and Sealed this

Twenty-eighth Day of January, 2003

JAMES E. ROGAN
*Director of the United States Patent and Trademark Office*